US011712703B2

(12) United States Patent
Dai et al.

(10) Patent No.: US 11,712,703 B2
(45) Date of Patent: Aug. 1, 2023

(54) SHOWER DEVICE WITH ADJUSTABLE ANGLE

(71) Applicant: RUNNER(XIAMEN) CORP., Fujian (CN)

(72) Inventors: Bifu Dai, Xiamen (CN); Xinzhan Hu, Fujian (CN)

( * ) Notice: Subject to any disclaimer, the term of this patent is extended or adjusted under 35 U.S.C. 154(b) by 149 days.

(21) Appl. No.: 17/308,104

(22) Filed: May 5, 2021

(65) Prior Publication Data

US 2022/0126310 A1 Apr. 28, 2022

(30) Foreign Application Priority Data

Oct. 23, 2020 (CN) ..... 202022373065.4

(51) Int. Cl.
*B05B 1/18* (2006.01)

(52) U.S. Cl.
CPC ..... *B05B 1/185* (2013.01)

(58) Field of Classification Search
CPC ..... B05B 1/18; B05B 1/185; B05B 15/60; B05B 15/62; B05B 15/63; B05B 15/65; B05B 15/652; B05B 15/654; B05B 15/658; B05B 15/68; E03C 1/06
See application file for complete search history.

(56) References Cited

U.S. PATENT DOCUMENTS

2016/0236223 A1* 8/2016 Scheffer ..... E03C 1/06
2017/0014849 A1* 1/2017 Gao ..... B05B 15/62
2018/0104707 A1* 4/2018 Lin ..... B05B 1/1609
2018/0339300 A1* 11/2018 Lin ..... B05B 15/65
2019/0083991 A1* 3/2019 Lin ..... F16B 1/00
2019/0323214 A1* 10/2019 Wang ..... E03C 1/0409
2020/0122166 A1* 4/2020 Farley ..... B05B 15/62
2021/0040715 A1* 2/2021 Lin ..... E03C 1/06
2021/0053083 A1* 2/2021 Zhuo ..... B05B 15/62
2021/0060598 A1* 3/2021 Lee ..... B05B 1/18
2021/0198877 A1* 7/2021 Wu ..... E03C 1/0408

* cited by examiner

*Primary Examiner* — Darren W Gorman
(74) *Attorney, Agent, or Firm* — Jose Cherson Weissbrot

(57) ABSTRACT

The present invention discloses a shower device with adjustable angle, which comprises a fixed seat and a shower head, the fixed seat is provided with a water inlet channel and a water outlet channel communicating with the water inlet channel, the water outlet channel is matched with one end of a hose, and the other end of the hose is connected with the shower head, wherein the top of the fixed seat is provided with a ball head, the bottom of the fixed seat is provided with an elastic buckle capable of telescoping, and the top of the shower head is provided with a clamping slot that can be engaged with the elastic buckle, and the clamping slot extending in the direction of the handle of the shower head, as first magnetic part is further arranged in the fixed seat, and a second magnetic part matched with the first magnetic part is arranged in the shower head. Through the design of the above-mentioned structure, the utility model realizes the automatic positioning of the shower head and the fixed seat when approaching, so that the elastic buckle can be quickly engaged with the clamping slot, and the design of the ball head realizes the adjustment of the angle of the shower head.

7 Claims, 6 Drawing Sheets

SHOWER DEVICE WITH ADJUSTABLE ANGLE

FIELD AND BACKGROUND OF THE INVENTION

Technical Field

The present invention relates to a shower device with adjustable angle.

Background

At present, among the shower base combinations on the market, the connection modes between the shower and the base are plug-in type, suspension type and magnetic connection type. The plug-in type has the problems that the appearance integrity is not strong, and the shower head needs to be lifted up, which is not in line with ergonomics. The suspension type has the problems that the suspension type belongs to as blind hanging type, and the shower head is not hung well, moreover, the shower head also needs to be lifted up, which is not in fine with ergonomics. Although the existing magnetic connection shower has changed the above problems of plug-in and suspension type shower, but some of the current magnetic connection showers require the hole, and some cannot directly adjust the shower angle through the shower handle, which the shower angle can only be adjusted at a higher ball head, and the user experience is not good.

SUMMERY OF THE PRESENT INVENTION

In order to solve above the technical problem, the present invention aims to provide shower device with an adjustable angle, which specifically realizes the adjustable effect of the shower head and improves the convenience of hanging at the same time.

The present invention discloses a following technical scheme realizes:

a shower device with adjustable angle, comprising a fixed seat and a shower head, the fixed seat is provided with a water inlet channel and a water outlet channel communicating with the water inlet channel, the water outlet channel is matched with one end of a hose, and the other end of the hose is connected with the shower head, wherein the top of the fixed seat is provided with a ball head, the bottom of the fixed seat is provided with an elastic buckle capable of telescoping, and the top of the shower head is provided with a clamping slot that can be engaged with the elastic buckle, and the clamping slot extending in the direction of the handle of the shower head, a first magnetic part is further arranged in the fixed seat, and a second magnetic part matched with the first magnetic part is arranged in the shower head.

In an embodiment of the present invention, the top end face of the shower head is provided with a raised portion, the raised portion is provided with a recessed portion, and the recessed portion forms the clamping slot that cooperates with the elastic buckle.

In the embodiment of the present invention, the elastic buckle comprises a matching part and a clamping part, and the matching part and the clamping part are in a "Z" shape.

In an embodiment of the present invention, the fixed seat is internally provided with an elastic buckle support for fixing the elastic buckle, the elastic buckle support is provided with a sliding groove that matched with the elastic buckle, and the elastic buckle support is further provided with a first guide pillar, the elastic buckle is provided with a second guide pillar, and a spring is arranged between the first guide pillar and the second guide pillar.

In an embodiment of the present invention, an upper disc part for fixing the first magnetic part is thither arranged in the fixed seat.

In an embodiment of the present invention, and a lower disc part for fixing the second magnetic part is arranged in the shower head.

In an embodiment of the present invention, the shower head is provided with a sunk groove, and the raised portion is arranged on the lower disc part.

In an embodiment of the present invention, the recessed portion is in an arc-shaped.

In an embodiment of the present invention, the second magnetic part is arranged on the inner side end face of the lower disc part, and is specifically located beside the recessed portion.

In an embodiment of the present invention, the first magnetic part is arranged on the inner side end face of the upper disc part.

The present invention discloses a shower device with adjustable angle, which has following beneficial effect:

1. The shower head and the fixed seat are hooked with the elastic buckle and the clamping slot to enhance the stability of the hooking. At the same time, the direction of the clamping slot extends along the direction of the shower handle, so that the user pulls down when disassembling, which it is more convenient for users to operate. In addition, through the positioning function of the first magnetic part and the second magnetic part, the fixed cooperation between the shower head and the fixed seat is better realized.

2. The ball head is arranged on the fixed seat, so that when the shower head is hang on the fixed seat, the water outlet angle can be adjusted.

DRAWINGS

In order to more clearly illustrate the technical solution of the present invention, the drawings required for the embodiment or the prior art description will be briefly introduced below, it is obvious that the drawings in the following description are only some embodiments of the present invention, and other drawings can be obtained by those skilled in the art without inventive efforts.

Figure 1:
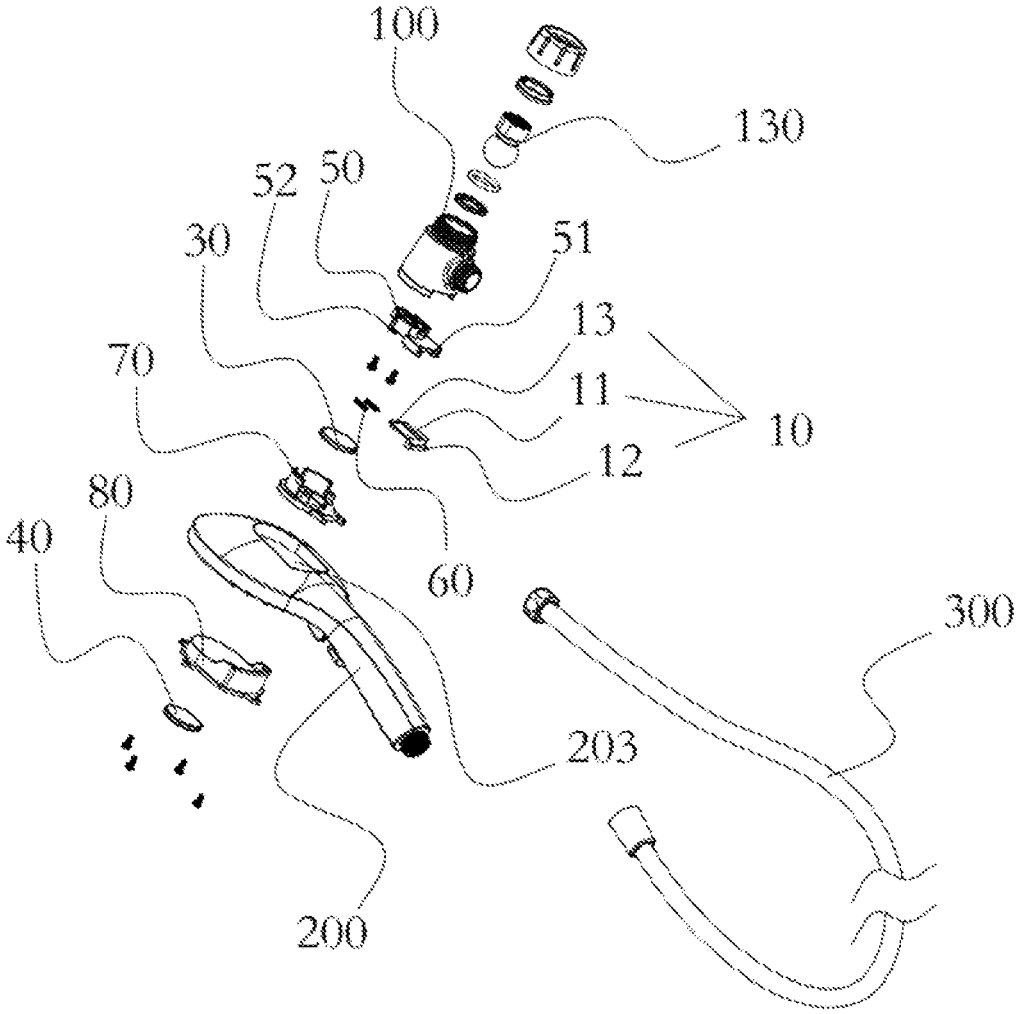
FIG. 1 is an exploded view of the present invention.
Figure 2:
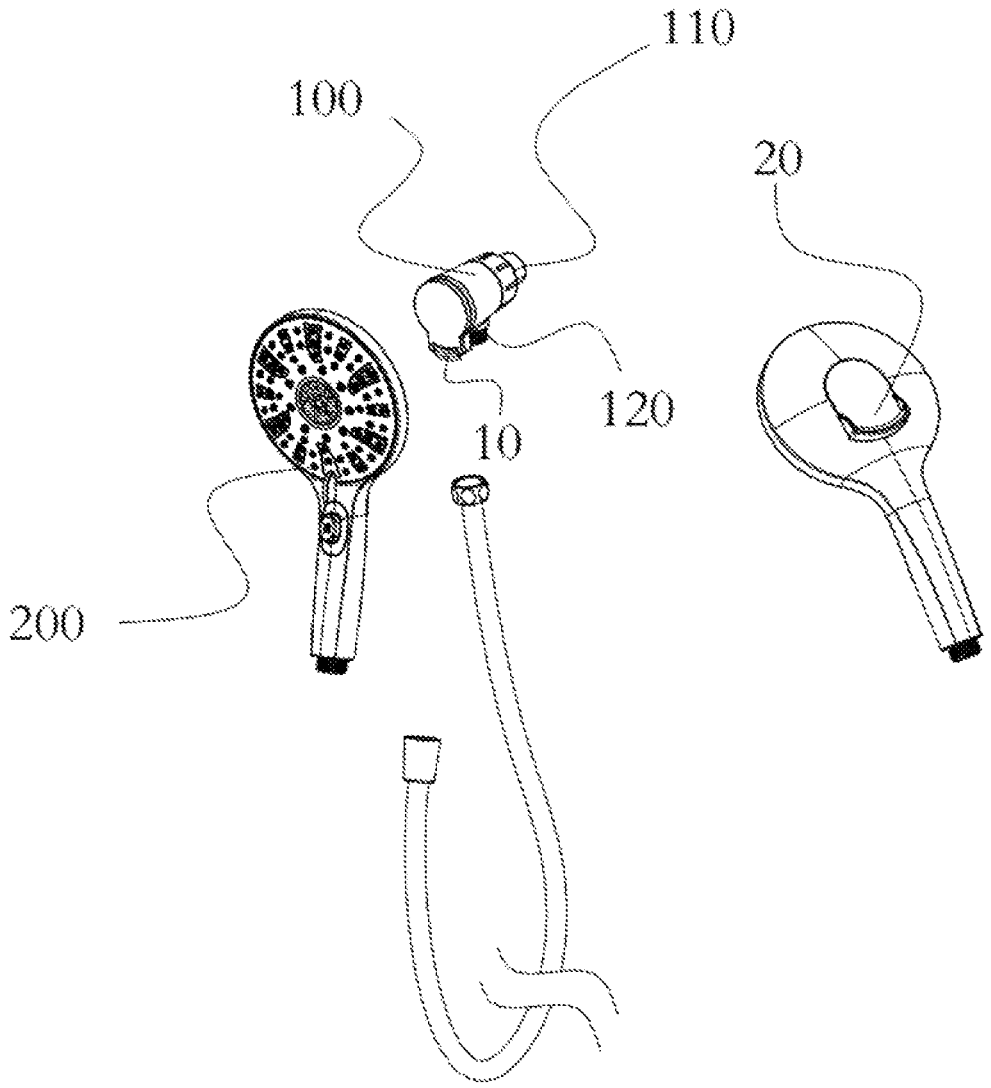
FIG. 2 is an exploded view of the present invention.
Figure 3:
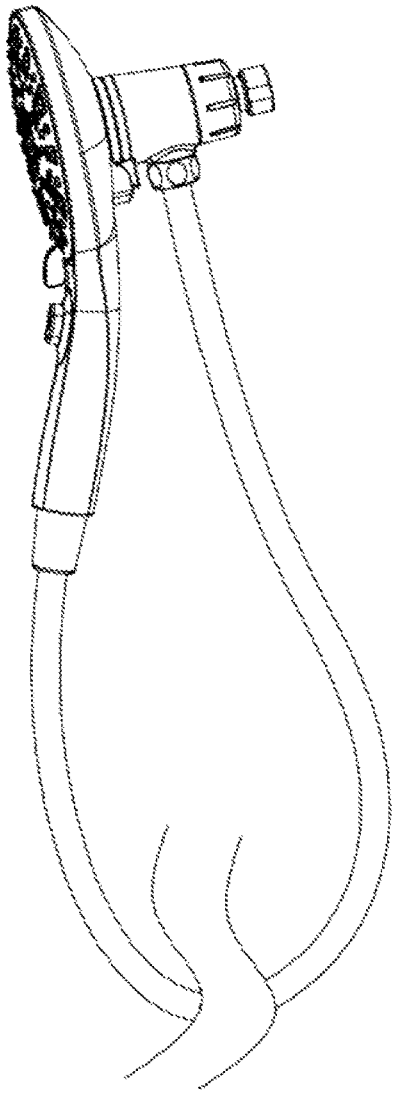
FIG. 3 is a schematic diagram of the present invention.
Figure 4:
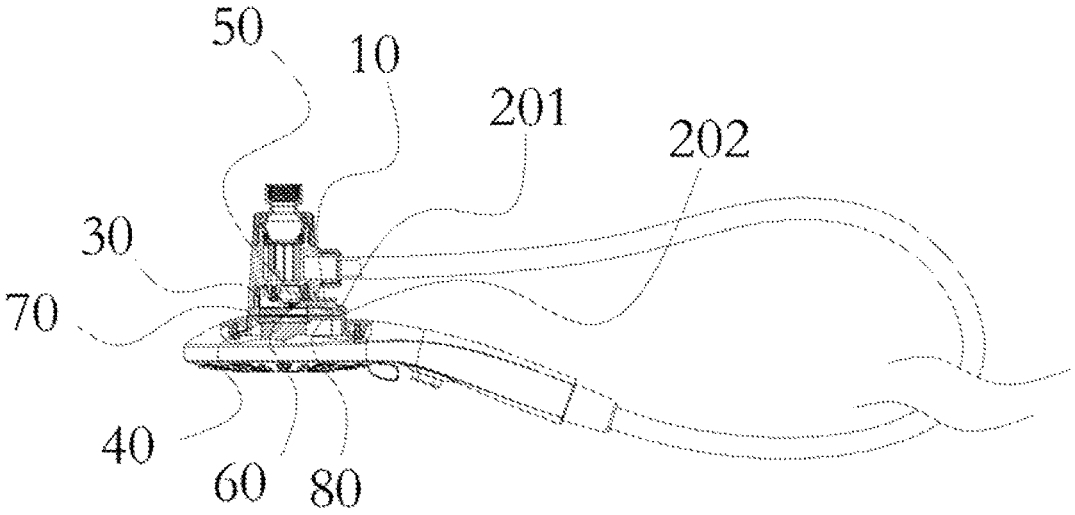
FIG. 4 is a cross-sectional view of the present invention.

In the figure: 10—an elastic buckle; 11—a matching part; 12—a clamping part; 13—a second guide pillar; 20—a clamping slot; 30—a first magnetic part; 40—a second magnetic part; 50—an elastic buckle support; 51—a sliding groove; 52—first guide pillar; 60—a spring; 70—an upper disc part; 80—lower disc part; 100—a fixed seat; 110—a water inlet channel; 120—a water outlet channel; 130—ball head; 200—a shower head; 201—a raised portion; 202—a recessed portion; 203—sunk groove; 300—a hose.

DETAILED DESCRIPTION

The technical solutions in the embodiments of the present invention will be described clearly and completely below with reference to the accompanying drawings in the embodiments of the present invention, and it is obvious that the described embodiments are only some embodiments of the present invention, not all embodiments. Based on the embodiments of the present invention, all other embodiments obtained by a person skilled in the art without creative efforts belong to the protection scope of the present invention.

Referring to the attached drawings of the specification, a shower device with adjustable angle comprises a fixed seat 100 and a shower head 200, wherein the fixed seat 100 is provided with a water inlet channel 110 and a water outlet channel 120 communicating with the water inlet channel 110, the water outlet channel 120 is matched with one end of a hose 300, and the other end of the hose 300 is connected with the shower head 200, wherein the top of the fixed seat 100 is provided with a ball head 130, the bottom of the fixed seat 100 is provided with an elastic buckle 10 capable of telescoping, and the top of the shower head 200 is provided with a clamping slot 20 that can be engaged with the elastic buckle 10, and the clamping slot 20 extending in the direction of the handle of the shower head 200, a first magnetic part is further arranged in the fixed seat 100, and a second magnetic part 40 matched with the first magnetic part 30 is arranged in the shower head 200. Through the design of the above-intentioned structure, the present invention realizes the quick coupling function between the shower head 200 and the fixed seat 100, meanwhile, the present invention realizes that the shower head 200 acts downward when the shower head 200 is disassembled from the fixed seat 100, which is more convenient the user to operate. At the same time, the design of the ball head 130 realizes that the water outlet angle of the shower head can be adjusted when the shower head 200 is hung on the fixed seat 100, which greatly enhances the flexibility.

Further, the top end face of the shower head 200 is provided with a raised portion 201, the raised portion 201 is provided with a recessed portion 202, and the recessed portion 202 forms the clamping slot 20 that cooperates with the elastic buckle 10.

Furthermore, the elastic buckle 10 comprises a matching part 11 and a clamping part 12, and the matching part 11 and the clamping part 12 are in a "Z" shape.

Further, the fixed seat 100 is internally provided with an elastic buckle support 50 for fixing the elastic buckle 10, the elastic buckle support 50 is provided with a sliding groove 51 that matched with the elastic buckle 10, and the elastic buckle support 50 is further provided with a first guide pillar 52, the elastic buckle 10 is provided with a second guide pillar 13, and a spring 60 is arranged between the first guide pillar 52 and the second guide pillar 13, the spring 60 and the elastic buckle 10 are matched to enable the clamping part 12 to clamp the recessed portion 202 well.

Further, an upper disc part for fixing the first magnetic part 30 is further arranged in the fixed seat 100, and a lower disc part 80 for fixing the second magnetic part 40 is arranged in the shower head 200, more specifically, the shower head 200 is provided with a sunk groove 203, and the raised portion 201 is arranged on the lower disc part 80, the recessed portion 202 is in an arc-shaped.

Further, the second magnetic part 40 is arranged on the inner side end face of the lower disc part 80, and is specifically located beside the recessed portion 202, the first magnetic part 30 is arranged on the inner side end face of the upper disc part 70.

Figure 5:
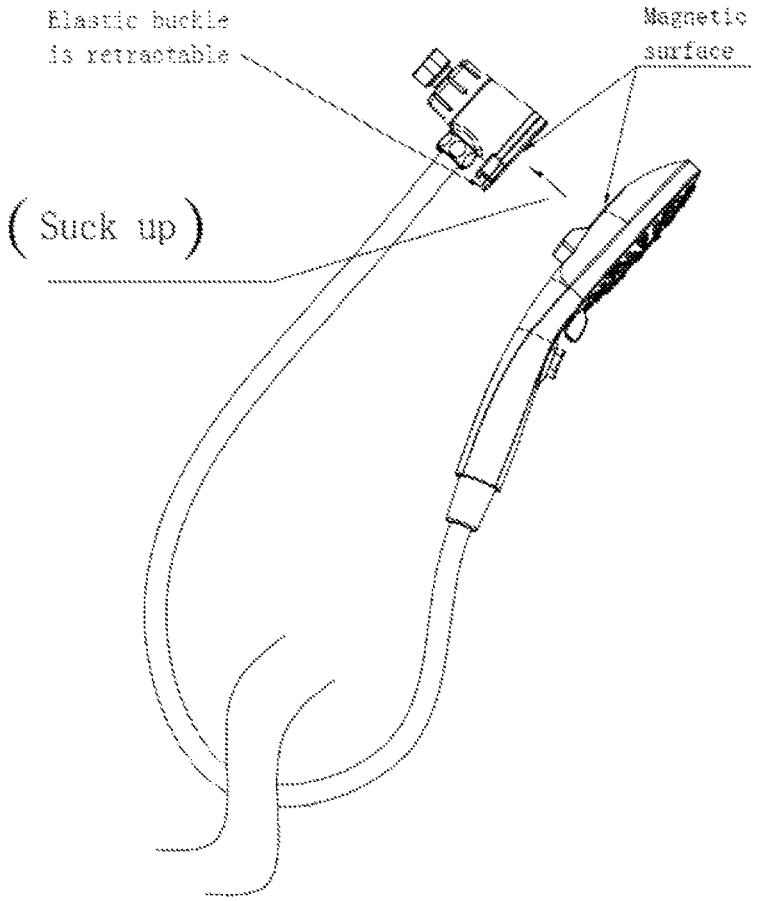
FIG. 5 is a schematic view of the fitting of the present invention 1.
Figure 6:
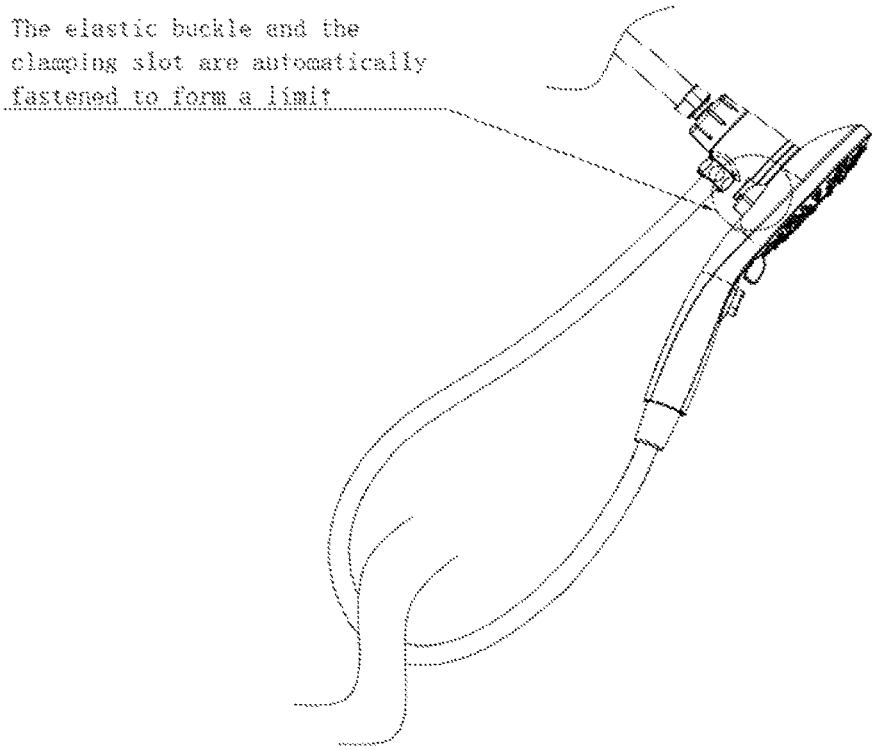
FIG. 6 is a schematic view of the fitting of the present invention 2.
Figure 7:
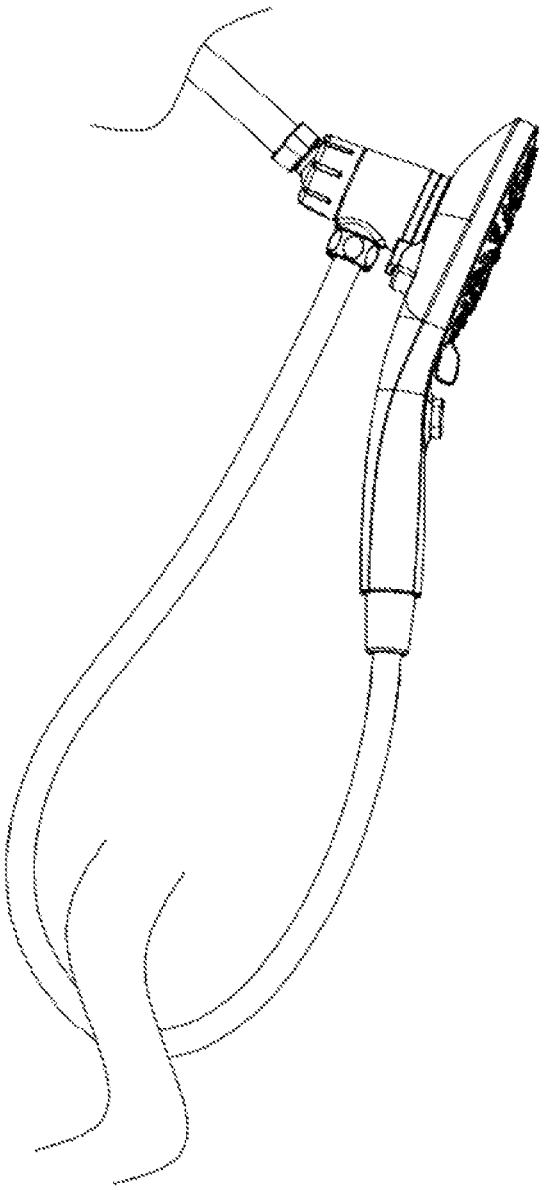
FIG. 7 is a schematic view of the fitting of the present invention 3.
Figure 8:
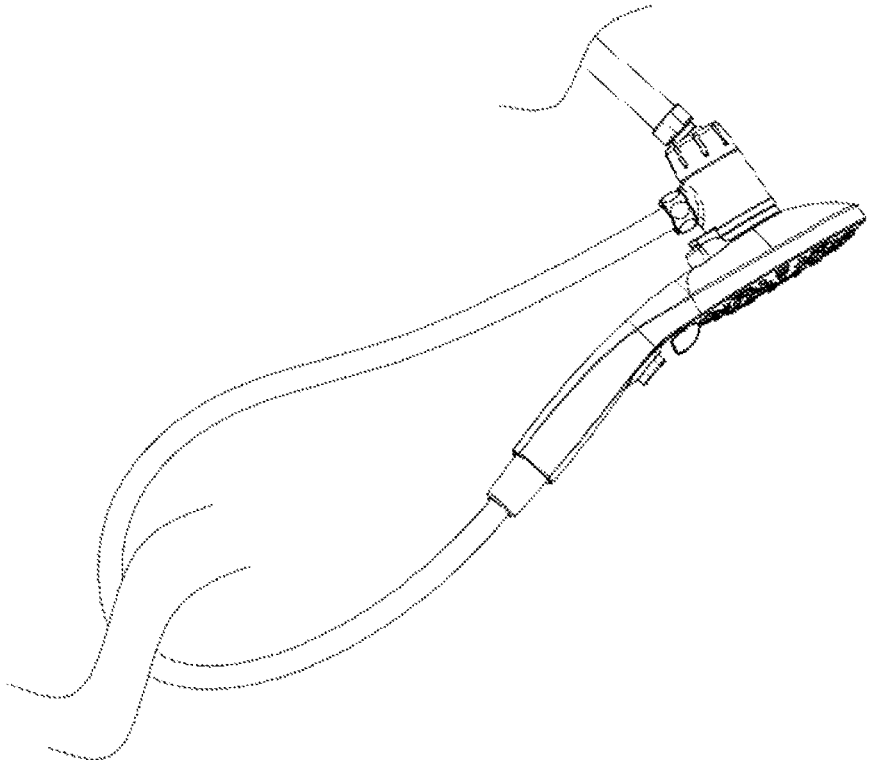
FIG. 8 is a schematic view of the fitting of the present invention 4.
Figure 9:
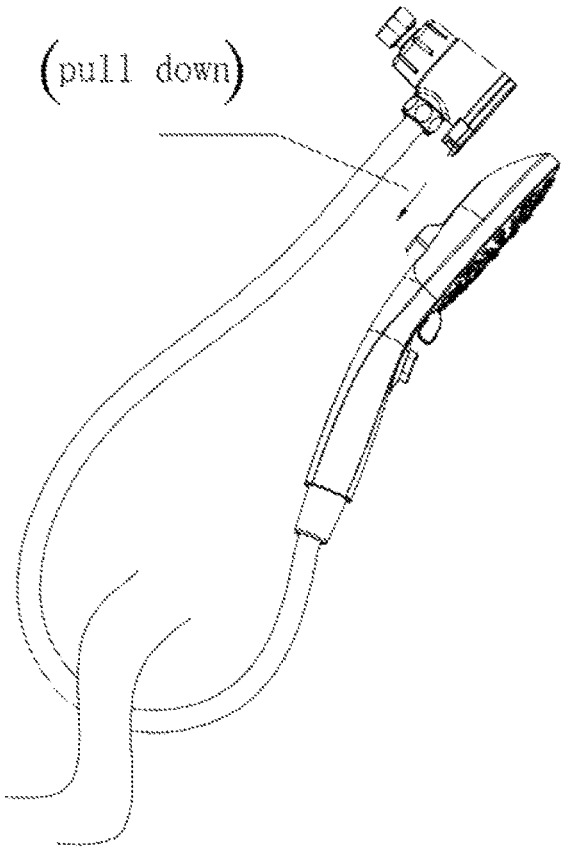
FIG. 9 is a schematic view of the fitting of the present invention 5.

In the process of use, when the shower 200 is close to the fixed seat 100, specifically when the first magnetic part 30 and the second magnetic part 40 are close to attract each other, and under the action of the attractive force, the shower head will be attracted to the fixing seat, so that the elastic buckle 10 and the clamping slot 20 will automatically buckle and clamp. When the clamping part 12 completely falls into the recessed portion 202, the spring 60 acts on the clamping part 12, so that the upper and lower ends of the clamping part 12 can act on the raised portion 201, so that the user can adjust the water outlet angle of the shower head by holding the handle of the shower head. In the cooperation of the shower head 200 and the fixed seat 100, the shower head is mainly fixed by the adsorption of the first magnetic part 30 and the second magnetic part 40 and the cooperation of the elastic buckle 10 and the clamping slot 20, and since the recessed portion 202 extends towards the handle direction of the shower head, when the user takes off the shower head, the user can take off the shower head by pulling downwards, which is more convenient and faster, and the specific reference is shown in FIG. 5-9 of the specification.

While the foregoing specification illustrates and describes the preferred embodiments of the present invention, it is to be understood that the invention is not limited to the forms disclosed herein, but is not to be construed as limited to the disclosed embodiments, and that modifications and environments may be resorted to, falling within the scope of the inventive concept as described herein, either as indicated by the above teachings or as modified by the skill or knowledge of the relevant art. But that modifications and variations may be effected by those skilled in the art without departing from the spirit and scope of the invention as defined bye the appended claims.

What is claimed is:

1. A shower device with adjustable angle, comprising a fixed seat and a shower head, the fixed seat is provided with a water inlet channel and a water outlet channel communicating with the water inlet channel, the water outlet channel is matched with one end of a hose, and the other end of the hose is connected with the shower head, wherein a top of the fixed seat is provided with a ball head, a bottom of the fixed seat is provided with an elastic buckle, and a top of the shower head is provided with a clamping slot that can be engaged with the elastic buckle, a first magnetic part is further arranged in the fixed seat, and a second magnetic part matched with the first magnetic part is arranged in the shower head;

a top end face of the shower head is provided with a raised portion, the raised portion is provided with a recessed portion, and the recessed portion forms the clamping slot that cooperates with the elastic buckle;

the elastic buckle comprises a matching part and a clamping part, and the matching part and the clamping part are in a "Z" shape;

the fixed seat is internally provided with an elastic buckle support for fixing the elastic buckle, the elastic buckle support is provided with a sliding groove that is matched with the elastic buckle, and the elastic buckle support is further provided with a first guide pillar, the elastic buckle is provided with a second guide pillar, and a spring is arranged between the first guide pillar and the second guide pillar.

2. A shower device with adjustable angle as claimed in claim 1, wherein an upper disc part for fixing the first magnetic part is further arranged in the fixed seat.

3. A shower device with adjustable angle as claimed in claim 1, wherein a lower disc part for fixing the second magnetic part is arranged in the shower head.

4. A shower device with adjustable angle as claimed in claim 3, wherein the shower head is provided with a sunk groove, and the raised portion is arranged on the lower disc part.

5. A shower device with adjustable angle as claimed in claim 4, wherein the recessed portion is arc-shaped.

6. A shower device with adjustable angle as claimed in claim 4, wherein the second magnetic part is arranged on an inner side end face of the lower disc part, and is specifically located beside the recessed portion.

7. A shower device with adjustable angle as claimed in claim 2, wherein the first magnetic part is arranged on an inner side end face of the upper disc part.

* * * * *